US009528508B2

(12) United States Patent
Thomeer et al.

(10) Patent No.: US 9,528,508 B2
(45) Date of Patent: Dec. 27, 2016

(54) PUMP ASSEMBLY

(75) Inventors: Hubertus V Thomeer, Houston, TX (US); Rod Shampine, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 948 days.

(21) Appl. No.: 13/393,634

(22) PCT Filed: Aug. 27, 2010

(86) PCT No.: PCT/IB2010/053868

§ 371 (c)(1),
(2), (4) Date: Mar. 1, 2012

(87) PCT Pub. No.: WO2011/027274

PCT Pub. Date: Mar. 10, 2011

(65) Prior Publication Data

US 2012/0164004 A1 Jun. 28, 2012

Related U.S. Application Data

(60) Provisional application No. 61/239,654, filed on Sep. 3, 2009.

(51) Int. Cl.
*F04B 53/14* (2006.01)
*F04B 37/12* (2006.01)

(52) U.S. Cl.
CPC ..... *F04B 37/12* (2013.01); *F04B 53/144* (2013.01); *F04B 53/147* (2013.01); *Y10T 29/49236* (2015.01)

(58) Field of Classification Search
CPC ..... F04B 53/144; F04B 53/146; F04B 53/147; F04B 1/00

(Continued)

(56) References Cited

U.S. PATENT DOCUMENTS 2,187,679 A * 1/1940 Chambers ..... 417/419
3,270,410 A 9/1966 Salter et al.

(Continued)

FOREIGN PATENT DOCUMENTS

CN 1151446 A 6/1997
CN 2625885 Y 7/2004

(Continued)

OTHER PUBLICATIONS

Office Action issued in related EA application 201270371 on Sep. 10, 2015, 5 pages.

(Continued)

*Primary Examiner* — Peter J Bertheaud
(74) *Attorney, Agent, or Firm* — Michael L. Flynn; Tim Curington

(57) ABSTRACT

A pump has power and fluid ends wherein one or more of the drive rods are offset from the plungers. An offset coupler connects a drive rod to an offset plunger. A method includes connecting the offset power end to the standard fluid end using the offset coupler. A repair and maintenance system includes inventories of standard fluid ends, power ends including offset power ends, and adapters, and a population of in service pumps, whereby the pumps can be repaired by removing and replacing the power ends from inventory using the adaptor where the replacement power end unit is offset. Another method includes removing and replacing the power end with one from the inventory, wherein the adapter is used in the case of an offset power end, whereby the offset and standard power ends may be used interchangeably.

20 Claims, 7 Drawing Sheets

(58) Field of Classification Search
USPC ..... 417/415, 454, 521, 538, 539; 92/73
See application file for complete search history.

(56) References Cited

U.S. PATENT DOCUMENTS

| | | | | |
|---|---|---|---|---|
| 4,034,585 | A | | 7/1977 | Straub |
| 4,106,393 | A | | 8/1978 | Dodson et al. |
| 4,354,371 | A | | 10/1982 | Johnson |
| 4,771,627 | A | | 9/1988 | Speakman |
| 5,171,136 | A | | 12/1992 | Pacht |
| 5,778,759 | A | | 7/1998 | Johnson |
| 6,164,188 | A | * | 12/2000 | Miser ..... 92/84 |
| 6,230,537 | B1 | | 5/2001 | Easterbrook |
| 6,419,459 | B1 | | 7/2002 | Sibbing |
| 6,711,928 | B1 | | 3/2004 | Easterbrook |
| 6,997,685 | B2 | | 2/2006 | Lemmen |
| 7,484,452 | B2 | | 2/2009 | Baxter et al. |
| 8,061,030 | B2 | | 11/2011 | Outhouse |
| 8,069,699 | B2 | | 12/2011 | Glenn et al. |
| 8,402,806 | B2 | | 3/2013 | Glenn et al. |
| 8,465,268 | B2 | | 6/2013 | Baxter et al. |
| 8,601,687 | B2 | | 12/2013 | Ochoa et al. |
| 8,763,229 | B2 | | 7/2014 | Reid |
| 9,121,402 | B2 | | 9/2015 | Marshall et al. |
| 2004/0161351 | A1 | | 8/2004 | Forrest |
| 2007/0289351 | A1 | | 12/2007 | Glenn |
| 2008/0000065 | A1 | | 1/2008 | Ganguly |
| 2008/0014106 | A1 | | 1/2008 | Hofmann et al. |
| 2008/0066518 | A1 | | 3/2008 | Glenn et al. |
| 2008/0298991 | A1 | | 12/2008 | Trubnikov |
| 2009/0092510 | A1 | | 4/2009 | Williams et al. |
| 2009/0101092 | A1 | | 4/2009 | Ichinosawa et al. |

FOREIGN PATENT DOCUMENTS

| | | | |
|---|---|---|---|
| CN | 200999717 | Y | 1/2008 |
| CN | 201074581 | Y | 6/2008 |

OTHER PUBLICATIONS

International Search Report and Written Opinion issued in PCT/IB2010/053868 on May 26, 2011; 10 pages.
Office Action issued in Eurasian Patent Application No. 201270371/31 on Apr. 18, 2014; 4 pages (with English translation).
Office Action issued in Eurasian Patent Application No. 201270371/31 on Jan. 30, 2015; 4 pages (with English translation).
Office Action issued in Chinese Patent Application No. 201080047310.9 on Jun. 25, 2014; 8 pages (with English translation).
Office Action issued in Chinese Patent Application No. 201080047310.9 on Mar. 16, 2015; 6 pages (with English translation).
International Search Report and Written Opinion issued in PCT/IB2010/053867 on May 20, 2011; 8 pages.
Office Action issued in Chinese Patent Application No. 201080047326.X on Apr. 1, 2014; 11 pages (with English translation).
Written Opinion issued in Singapore Patent Application No. 201201525-1 on Apr. 17, 2013; 5 pages.
Office Action issued in Eurasian Patent Application No. 201270370/31 on Mar. 31, 2014; 7 pages (with English translation).
Office Action issued in Eurasian Patent Application No. 201270370/31 on Nov. 21, 2014; 5 pages (with English translation).
Notice on Readiness to Grant issued in Eurasian Patent Application No. 201270370/31 on Jan. 22, 2016; 6 pages with English translation).
Office Action issued in Mexican Patent Application No. MX/a/2012/002635 on Jan. 22, 2015; 7 pages (with English translation).
Office Action issued in Mexican Patent Application No. MX/a/2012/002638 on Mar. 22, 2016; 4 pages (with English translation).
Office Action issued in Eurasian Patent Application No. 201270371 on Sep. 10, 2015; 5 pages.

* cited by examiner

PUMP ASSEMBLY

This application is a 371 National Stage Application of International Application No. PCT/IB2010/053868 filed Aug. 27, 2010, which claims priority to U.S. Provisional Application No. 61/239,654 filed Sep. 3, 2009.

BACKGROUND OF THE INVENTION (1) Field of the Invention

The invention is related in general to wellsite surface equipment such as fracturing pumps and the like.

(2) Description of Related Art including information disclosed under 37 CFR 1.97 and 1.98

Multiplex reciprocating pumps are generally used to pump high pressure fracturing fluids downhole. Typically, the pumps that are used for this purpose have plunger sizes varying from about 9.5 cm (3.75 in.) to about 16.5 cm (6.5 in.) in diameter. These pumps typically have two sections: (a) a power end, the motor assembly that drives the pump plungers (the driveline and transmission are parts of the power end); and (b) a fluid end, the pump container that holds and discharges pressurized fluid.

In triplex pumps, the fluid end has three fluid cylinders. For the purpose of this document, the middle of these three cylinders is referred to as the central cylinder, and the remaining two cylinders are referred to as side cylinders. Similarly, a quintuplex pump has five fluid cylinders, including a middle cylinder and four side cylinders. A fluid end may comprise a single block having cylinders bored therein, known in the art as a monoblock fluid end.

The pumping cycle of the fluid end is composed of two stages: (a) a suction cycle: During this part of the cycle a piston moves outward in a packing bore, thereby lowering the fluid pressure in the fluid end. As the fluid pressure becomes lower than the pressure of the fluid in a suction pipe (typically 2-3 times the atmospheric pressure, approximately 0.28 MPa (40 psi)), the suction valve opens and the fluid end is filled with pumping fluid; and (b) a discharge cycle: During this cycle, the plunger moves forward in the packing bore, thereby progressively increasing the fluid pressure in the pump and closing the suction valve. At a fluid pressure slightly higher than the line pressure (which can range from as low as 13.8 MPa (2 Ksi) to as high as 145 MPa (21 Ksi)) the discharge valve opens, and the high pressure fluid flows through the discharge pipe.

The power end typically includes an engine such as a diesel or gasoline engine, a transmission and a driveline that provides the motive force to reciprocate the pump plungers via rods which are known in the art as pony rods. Often the power ends and fluid ends from different manufacturers are incompatible due to the misalignment of the pony rods and plungers, as well as different profiles and bolting patterns of the attachment flange of the power end relative to the connection block on the fluid end. Power ends may be produced by various manufacturers with considerable variability in the design and/or dimensions of the attachment flange, pony rods, driveline, etc., both between manufacturers as well as between different models from the same manufacturer.

Given a pumping frequency of 2 Hz, i.e., 2 pressure cycles per second, the fluid end body can experience a very large number of stress cycles within a relatively short operational lifespan. These stress cycles, together with the high operating pressures, the difficult nature of the fluids being pumped, and often extreme environmental conditions, gives rise to high maintenance requirements both on the fluid end as well as the power end.

Frequently it is desired to remove power end and/or fluid end pump assembly components from a working pump and replace them with components from inventory to keep the pump assembly in operation while the removed component can be repaired and returned to inventory; however, there are substantial differences between different pump assembly makes and models such that a relatively large inventory is required to provide suitable replacement power ends and/or fluid ends for every type an enterprise may have in operation. A power end from one manufacturer, for example, may not have the proper orientation of drive rods and tie rods to the fluid end of another manufacturer, or the appropriate stroke length. Standardization of fluid ends and pump ends for one manufacturer can lead to sourcing and pricing issues and for these reasons it is advantageous to have a wide range of suppliers for the various pump components.

It remains desirable to provide improvements in wellsite surface equipment in efficiency, flexibility, reliability, and maintainability.

BRIEF SUMMARY OF THE INVENTION

The present invention in one embodiment uses an adapter to connect up a power end to a fluid end of a pump assembly where the power end has drive rods that are offset from the plungers of the fluid end. In this embodiment non-standard power ends of different makes and models can be interchangeably adapted for use with the same fluid end.

In one embodiment, a pump assembly comprises: a power end comprising a plurality of reciprocatable drive rods arranged in a first geometric pattern; a fluid end comprising a plurality of plungers arranged in a second geometric pattern wherein the second geometric pattern is different from the first geometric pattern; and an adaptor to connect the power end to the fluid end, wherein the adaptor comprises an offset coupler to attach a said drive rod to an offset one of the plungers.

In an embodiment, the adaptor further comprises an in-line coupler to attach a said drive rod to an aligned one of the plungers. In an embodiment, the first and second geometric patterns comprise a straight line, wherein the drive rods and plungers are transversely oriented on opposite sides of the line, and wherein spacing between the drive rods is different from spacing between the plungers. In an embodiment, the pump assembly has a triplex or quintuplex fluid end wherein a middle one of the plungers is coupled in alignment with a corresponding middle one of the drive rods, and wherein side ones of the plungers are connected with corresponding side ones of the drive rods using a respective plurality of the offset couplers.

In an embodiment, the offset coupler comprises an eccentric clamp, which may comprise a split housing halves, a first opening and recess to receive the drive rod and an enlarged end thereof, a second opening and recess to receive the plunger and an enlarged end thereof, and a plurality of bolts to removable secure the housing halves.

In an embodiment, the adaptor further comprises a plurality of tie rods secured at opposite ends to the power end and the fluid end, wherein at least one of the tie rods includes an offset tie rod adapter to attach a first tie rod section from the power end with an offset second tie rod section from the fluid end.

In an embodiment, the offset tie rod adaptor comprises opposing first and second elongated blocks abutting at a sloping transverse surface, a through bore and a threaded bore formed in each of the first and second blocks, wherein the through bores of the first and second blocks are aligned at the transverse surface with the threaded bores of the respective second and first blocks, wherein the through bores are formed longitudinally in a portion of the blocks that is longer than a portion of the blocks in wherein the threaded bores are formed, wherein the first tie rod section is slideably received in the through bore of the first block and threadedly engaged in the threaded bore of the second block and wherein the second tie rod section is slideably received in the through bore of the second block and threadedly engaged in the threaded bore of the first block.

In an embodiment, the fluid end comprises a plurality of pump body modules secured together to form the fluid end, for example, in a line with fasteners between opposite end plates.

In another embodiment, a pump assembly and maintenance system, comprises: a standby inventory of standard fluid end assemblies comprising a standard plunger and tie rod configuration; a standby inventory of a plurality of different sets of power end units, wherein each set of power end units has a different drive rod and tie rod configuration with respect to the other power end sets, including at least one set of offset power ends having an offset drive rod and tie rod configuration with respect to the standard plunger and tie rod configuration; a standby inventory of adapter units to connect the offset power ends to the standard fluid ends; and a population of pump assemblies in service, comprising in-service pump assemblies comprising a said standard fluid end, a said adapter unit and a said offset power end, whereby the in-service pump assemblies can be repaired by removing the power end and replacing with a said power end from the standby inventory thereof wherein the replacement power end has a different drive rod and tie rod configuration with respect to the removed power end.

In an embodiment, the inventory of standard fluid end assemblies further comprises interchangeable pump body modules, wherein the fluid end assemblies comprise a plurality of the modules, whereby the in-service pump assemblies can be repaired by removing and replacing the standard fluid end assembly or one or more of the interchangeable pump body modules. In an embodiment, the inventory of power end units further comprise a set of standard power ends having a drive rod and tie rod configuration matching the standard plunger and tie rod configuration, and wherein the population of in-service pump assemblies further comprises pump assemblies comprising a standard power end coupled directly to a standard fluid end.

Another embodiment provides a method, comprising: (1) providing a power end comprising a plurality of reciprocatable drive rods arranged in a first geometric pattern; (2) providing a fluid end comprising a plurality of plungers arranged in a second geometric pattern wherein the second geometric pattern is different from the first geometric pattern; and (3) connecting the power end to the fluid end via an adaptor comprising an offset coupler to attach a said drive rod to an offset one of the plungers.

In an embodiment, the method also includes attaching a said drive rod to an aligned one of the plungers. In an embodiment, the method also includes transversely orienting the drive rods and plungers on opposite sides of a straight line wherein spacing between the drive rods is different from spacing between the plungers. In an embodiment, the fluid end comprises a triplex or quintuplex fluid end assembly, and the method also includes coupling a middle one of the plungers in alignment with a corresponding middle one of the drive rods, and connecting side ones of the plungers with corresponding side ones of the drive rods at a respective plurality of the offset couplers.

In an embodiment, the method also includes securing the power end and the fluid end together by securing opposite ends of a plurality of tie rods to the power end and the fluid end, comprising attaching a first tie rod section from the power end to an offset second tie rod section from the fluid end at an offset tie rod adapter.

In an embodiment, the method also includes assembling the fluid end from a plurality of pump body modules secured together, for example, securing the pump body modules in a line with fasteners between opposite end plates.

In a further embodiment a method comprises: (1) providing a standby inventory of standard fluid end assemblies comprising a standard plunger and tie rod configuration; (2) providing a standby inventory of a plurality of different sets of power end units, wherein each set of power end units has a different drive rod and tie rod configuration with respect to the other power end sets, including at least one set of offset power ends having an offset drive rod and tie rod configuration with respect to the standard plunger and tie rod configuration; (3) providing a standby inventory of adapter units adapted to connect the offset power ends to the standard fluid ends; (4) connecting a said standard fluid end, a said adapter unit and a said offset power end from the standby inventories into a pump assembly; (5) placing a plurality of the pump assemblies in service; and (6) removing the power end of one of the in-service pump assemblies for repair or maintenance and replacing it with a said power end from the standby inventory, wherein the replacement power end has a different drive rod and tie rod configuration with respect to the removed power end.

In an embodiment, the inventory of standard fluid end assemblies further comprises interchangeable pump body modules, wherein the fluid end assemblies comprise a plurality of the modules, and the method also includes removing the standard fluid end assembly or one or more of the interchangeable pump body modules for repair or maintenance and replacing it with another one from the inventory of standard fluid end assembly or one or more of the interchangeable pump body modules.

In an embodiment, the inventory of power end units further comprise a set of standard power ends having a drive rod and tie rod configuration matching the standard plunger and tie rod configuration, and the method also includes connecting a said standard fluid end and a said standard power end from the respective inventories into a pump assembly.

DETAILED DESCRIPTION OF THE INVENTION

Figure 1:
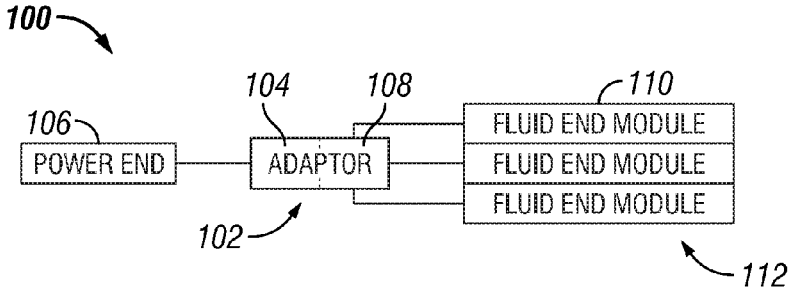
FIG. 1 is a schematic diagram of a triplex pump assembly according to an embodiment of the invention.

With reference to FIG. 1, in an embodiment a pump assembly 100 includes an adaptor 102, comprising a first mechanical attachment portion 104 for attaching to the drive rods extending from the power end 106 and a second mechanical attachment portion 108 for attaching to the fluid end modules 110 making up the fluid end assembly 112. By virtue of the fluid end modules 110 and the appropriate adaptor 102, the operator and/or assembler has the ability to create the assembly 100 comprising the adaptor 102, the fluid end assembly 112, and the power end 106 such that the design of the fluid end assembly 112 and/or fluid end modules 110 may remain the same regardless of the type of power end 106 utilized to form the assembly 100. Such an assembly 100 may be advantageously cost-effective and allow for greater maintainability of the fluid end modules 110 and the fluid end assembly 112.

In one embodiment where the fluid end modules have substantially identical profiles, i.e., interchangeability of the fluid end modules 110 in the various fluid end assemblies 112, the modules 110 may be advantageously interchanged between the middle and sides in the fluid end assemblies 112, providing advantages in assembly, disassembly, and maintenance. In operation, if one of the pump body modules 110 fails, only the failed one of the modules 110 need be replaced, reducing the potential overall downtime of a fluid end assembly 112. In one embodiment, the pump body modules 110 are smaller than a typical monoblock fluid end having a single body with a plurality of cylinder bores machined therein, and therefore provide greater ease of manufacturability due to the reduced size of forging, castings, etc.

The adaptor 102 advantageously allows an operator and/or assembler to orient the fluid end modules 110 for attachment to the power end 106, regardless of the type of power end 106, e.g., power ends from different manufacturers and/or different models of power ends from the same manufacturer. If necessary, the adaptor 102 can allow for multi-axis adjustments for attaching the fluid end modules 110 to the power end 106. The adaptor 102, therefore, may allow the operator and/or assembler to make both lateral and longitudinal spacing adjustments between the plungers of the fluid end modules 110 and the drive rods of the power end 106 to account for relative spacing and alignment adjustments as well as to allow for adjustments in the stroke of the drive rods and pump plungers.

Figure 2:
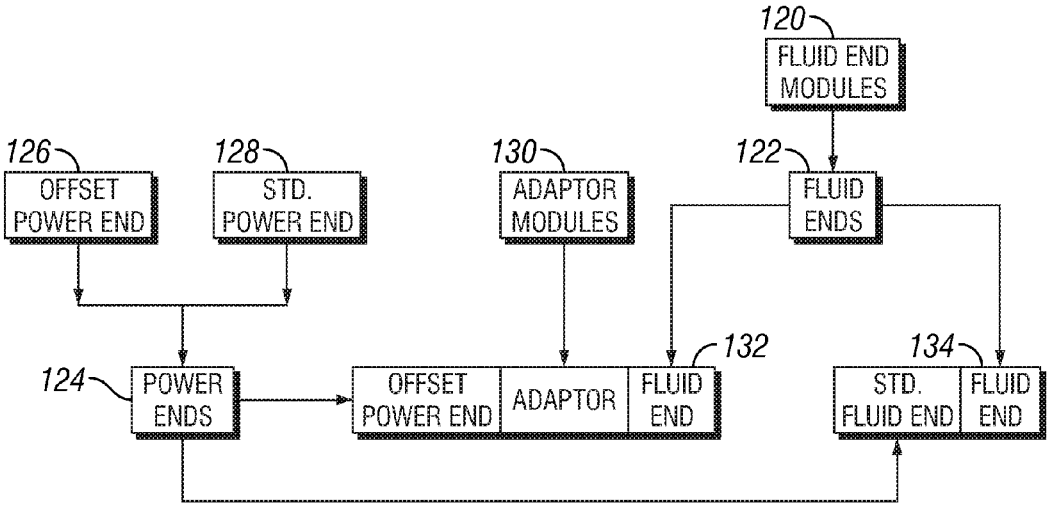
FIG. 2 is a schematic diagram of a maintenance inventory system according to an embodiment.

The adaptor 102 allows the use of relatively small inventories of fluid end modules 110 and/or fluid end assemblies 112 for attachment to a variety of power ends 106. With reference to FIG. 2, an inventory system for the assembly and/or maintenance of a population of operating pump assemblies may include an inventory 120 of a limited number of standardized fluid end modules, as well as other fluid end components and parts, used to assemble an inventory 122 of standardized fluid ends having the same general specifications as well as piston and tie rod configurations.

On the other hand, an inventory of power ends 124 can include offset power ends 126, as well as standard power ends 128, i.e., power ends having a drive rod and tie rod configuration compatible with that of the standard fluid ends in the inventory 122. The offset power ends 126, which have a different drive rod and/or tie rod configuration, with respect to the standard fluid ends in the inventory 122, may be made by a different manufacturer or may be a different model from the same manufacturer of the standard power ends 128. This allows the operator and/or assembler to obtain power ends that may be more readily available, lower cost, or more suited to the power requirements in the given application.

By maintaining a suitable adaptor inventory 130, including a set specific for each type of offset power end 126 that may be present in the inventory 124, the offset power ends 126 can be used with the appropriate adaptor in any one of the population 132 of the operating pump assemblies. The standard power ends 128 can be used in the population 134 of the operating pump assemblies by direct connection without one of the adaptors 130, or one of the adaptors 130 can optionally be used as a spacer element. In one embodiment, where more than one type of standard fluid end is used, e.g., triplex and quintuplex, the adaptor inventory 108 can include a set of adaptors specific to each type of fluid end in the inventory 122 and/or population 132; and additionally or alternatively, the different types of fluid ends may all have the same plunger and tie rod configuration throughout, e.g., where more than one type of fluid end module is used.

Figure 4:
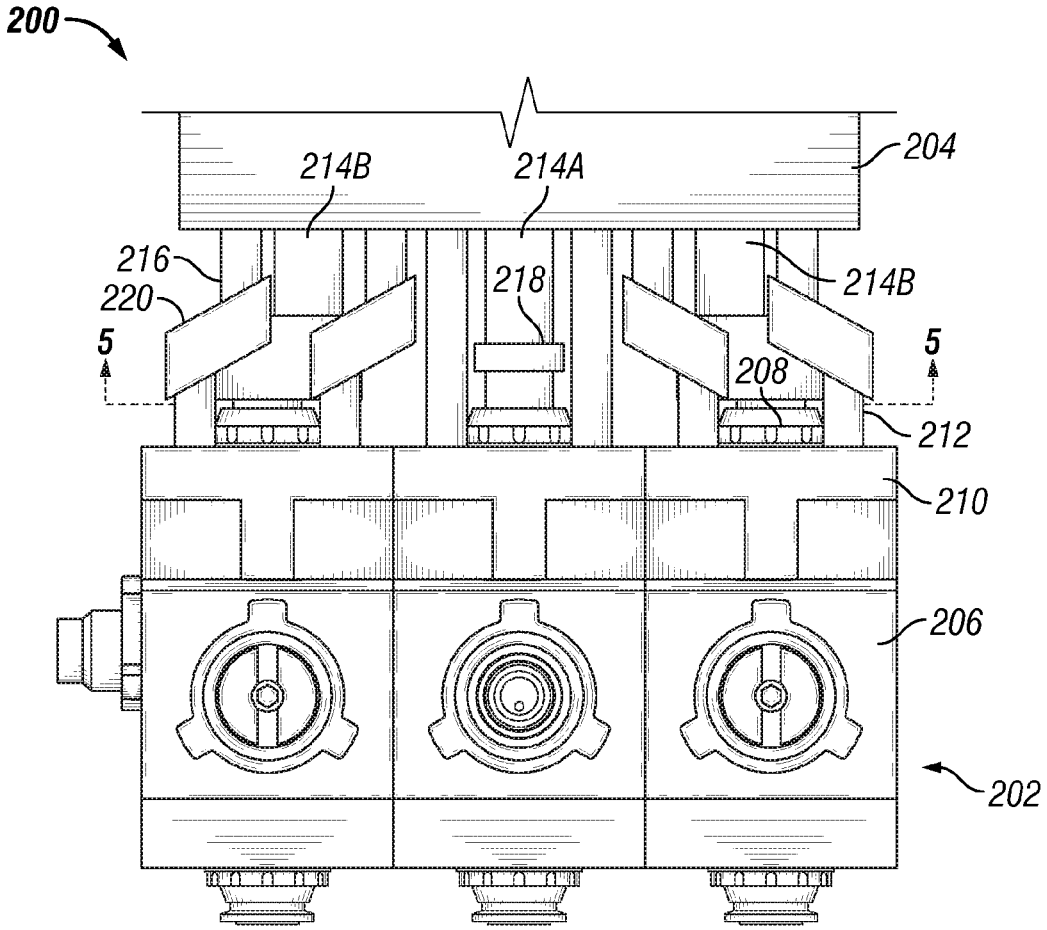
FIG. 4 a top plan view of a pump assembly according to an embodiment.
Figure 6:
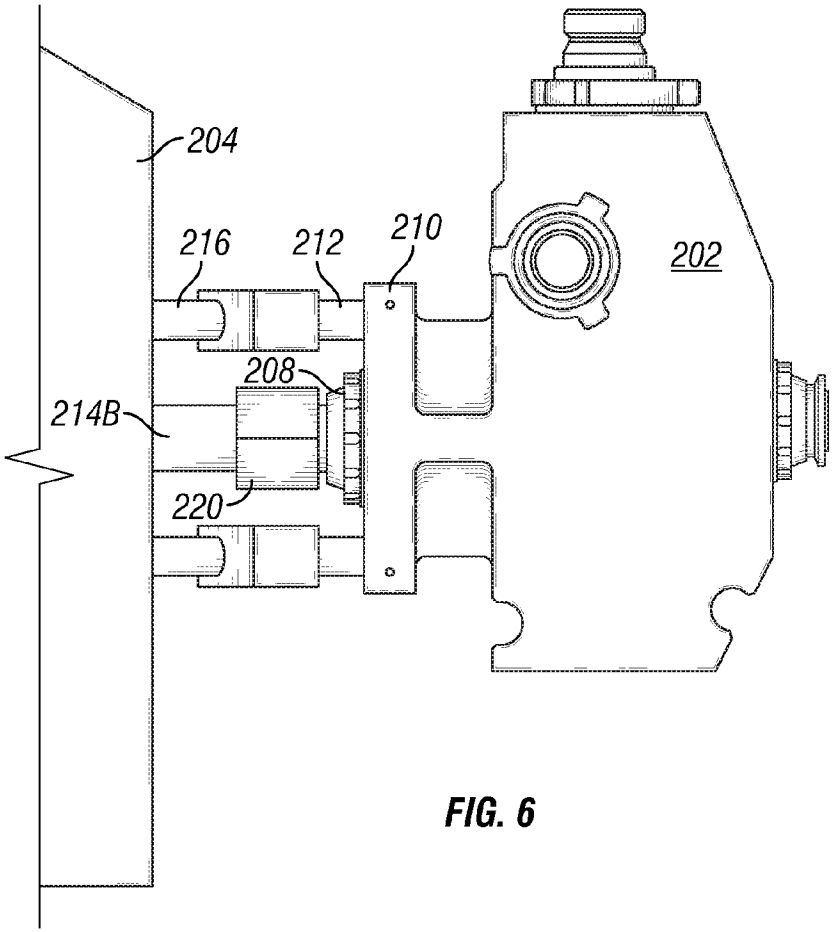
FIG. 6 is a side elevation view of the pump assembly of FIGS. 4-5 according to an embodiment of the invention.
Figure 5:
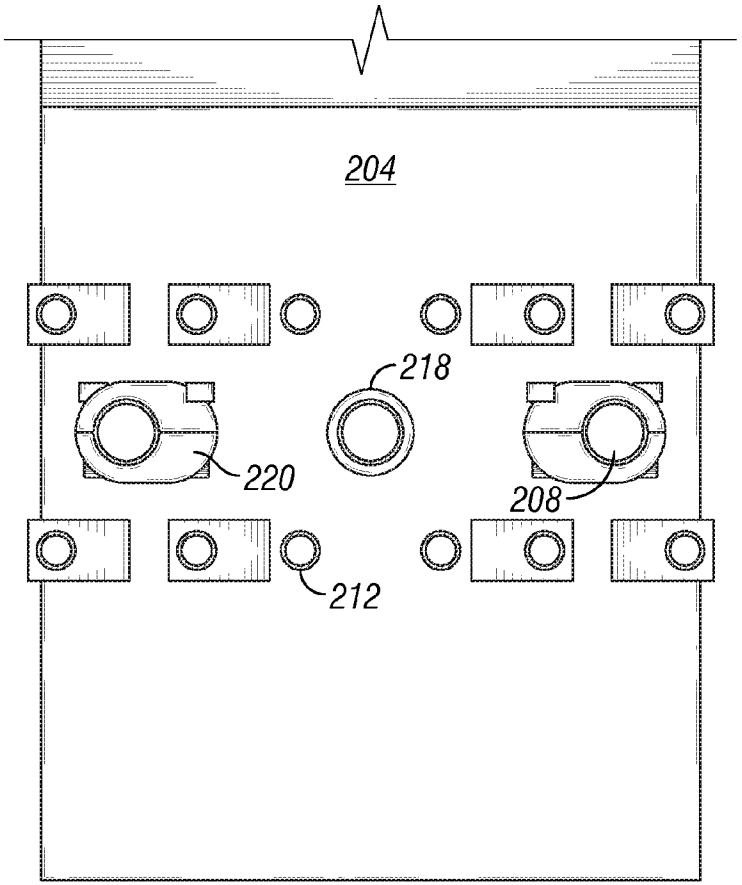
FIG. 5 is a sectional view of the pump assembly of FIG. 3 as seen along the lines 4-4 according to an embodiment.

FIGS. 4-6 illustrate a pump assembly 200 incorporating a standard triplex fluid end 202 and a non-standard or offset power end 204, according to one embodiment. The fluid end 202 comprises three interchangeable fluid end modules 206 which have a respective plunger 208 with a standard spacing in a line, and attachment flange 210 with a standard configuration for tie rods 212. The power end 204 has a middle drive rod 214A and side drive rods 214B, as well as a configuration for tie rods 216, that may or may not match the configuration for the fluid end plungers 208 and/or tie rods 212, in whole or in part.

An adaptor module in the particular example of this embodiment shown in FIGS. 4-6 includes a standard aligned plunger-drive rod clamp 218 for the middle drive rod 214A and the middle one of the plungers 208, and offset plunger-drive rod clamps 220 to connect the side drive rods 214B to the side ones of the plungers 208. In general, it is preferred to align one of the drive rods 214A, 214B with one of the plungers 208, preferably the middle drive rod 214A, to avoid space issues for the offset clamps 220 where the adjacent drive rods 214, 214B may not provide sufficient room for the use of adjacent offset clamps 220. The combination of the standard clamp 218 and the particular offset clamps 220 may be specific to each type of power end 204, depending on the plunger-drive rod offset distance and direction, and these may be inventoried separately as components, or alternatively and/or additionally as prepacked kits or packages comprising one, a plurality or all of the clamps 218, 220 required for assembly of a particular combination of power end 204 and fluid end assembly 202.

The adaptor module may also include offset bolt adaptors 222 as required for the offset tie rods 216. In general, the fluid end assembly 202 should have one or more tie rods 212 that align with the tie rod configuration for the offset power end 204, although it is possible that none or all of tie rods 212, 216 will align for which the offset bolt adaptors 222 are not required. As with the plunger clamps 218, 220, the offset bolt adaptors 222 and tie rods 212, 216 of the appropriate number, diameter, thread pitch, length, etc. may be inventoried separately and/or as part of a kit labeled for the particular combination of power end 204 and fluid end assembly 202.

Figure 3:
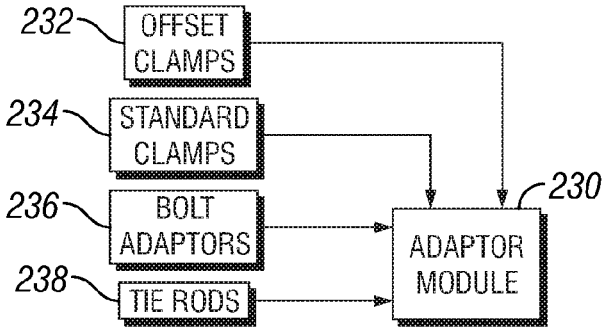
FIG. 3 is a schematic diagram of an adaptor module according to an embodiment.

FIG. 3 illustrates one embodiment of a prepackaged adaptor module 230 which can be populated with the required number and type of offset drive rod-plunger clamps 232, standard clamps 234, bolt adaptors 236, tie rods 238, and so on, for a particular power end-fluid end assembly. The module 230 can be inventoried separately, or additionally or alternatively paired with the appropriate power end. Additionally or alternatively a module 230 can include additional components 232, 234, 236, 238 necessary for connecting a plurality of some or all of the different types of power ends or in different configurations or types of configurations so that the number of adaptor modules kept in inventory is minimized. Additionally the adaptor modules may include spare or extra components 232, 234, 236, 238 for the assembly, and may include any other parts frequently or occasionally used in making a fluid pump assembly.

Figure 7:
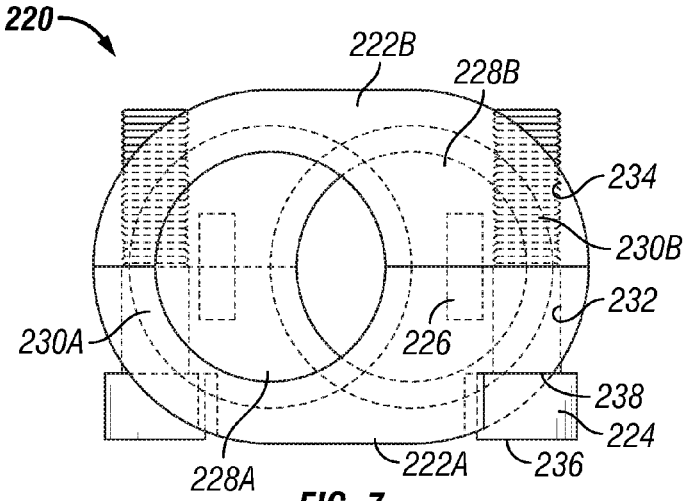
FIG. 7 is an end view of an offset plunger-drive rod clamp assembly according to an embodiment.
Figure 8:
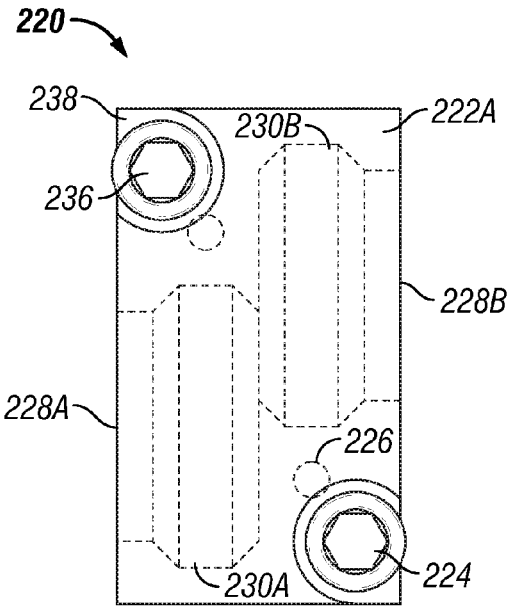
FIG. 8 is a top plan view of the clamp of FIG. 7 according to an embodiment.
Figure 9:
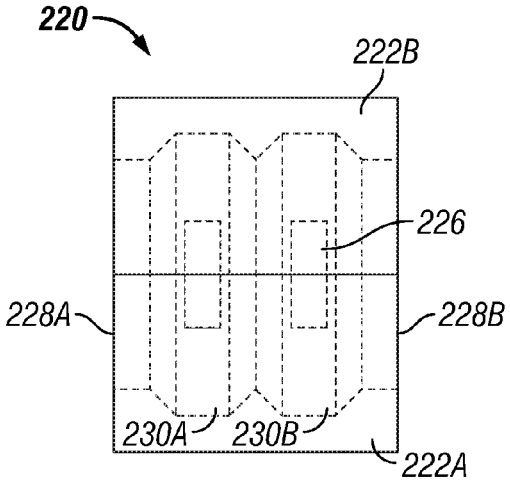
FIG. 9 is a side elevational view of the clamp of FIGS. 7-8 according to an embodiment.

FIGS. 7-9 show an embodiment of an offset plunger-drive rod clamp 220 having a housing comprised of two split sections 222A, 222B, bolts 224 and alignment pins 226. In this example, openings 228A, 228B and recesses 230A, 230B are provided and formed in the assembled sections 222A, 222B appropriately offset to receive a shaft and end or flange of the respective power end drive rod and fluid end plunger.

To assemble the clamp 220, after installing the fluid end and power end, the plunger and drive rod ends are brought together in the appropriate offset and the clamp sections 222A, 222B are brought together around the plunger/drive rod ends, using the pins 226 for alignment, and the bolts 224 are secured in place. In this embodiment, the clamp section 222A has an enlarged through bore 232 and the clamp section has a threaded bore 234 to engage threads on the bolt 224 which draws the cap 236 tightly against the recessed surface 238 to secure the clamp sections 222A, 222B together, holding the opposing ends of the plunger and drive rod in the appropriate offset alignment. The particular clamp illustrated is merely for purposes of non-limiting example and other suitable clamping arrangements will occur to those skilled in the art.

Figure 10:
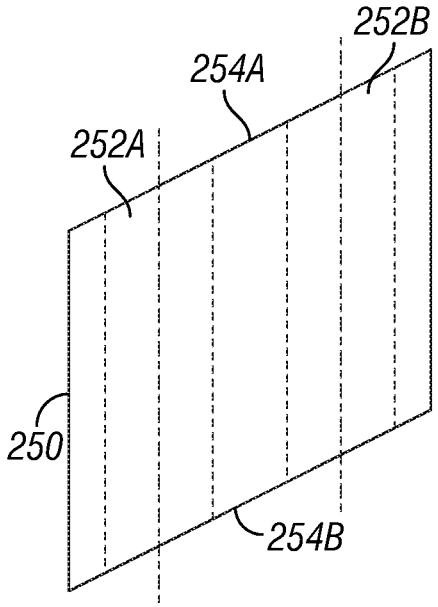
FIG. 10 is a top plan view of an offset tie rod adaptor according to an embodiment.
Figure 11:
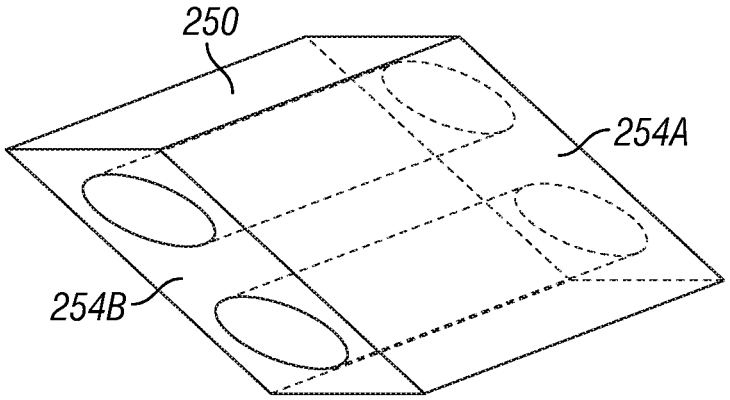
FIG. 11 is a perspective view of the adaptor of FIG. 10 according to an embodiment.

FIGS. 10-11 illustrate an embodiment of an offset tie rod adaptor or an offset bolt adaptor 250 which can be used to connect offset tie rods between the power end and the fluid end. The adaptor 250 is a block having a pair of threaded bores 252A, 252B to receive the proximal ends of offset tie rod sections having their opposite ends secured to the power end and the fluid end assembly. The offset of the bores 252A, 252B matches the offset between the configuration of the tie rod sections. If desired, the end faces 254A, 254B through which the bores 252A, 252B are formed may be transversely oriented with respect to a plane that is at a right angle to the bores.

Figure 12:
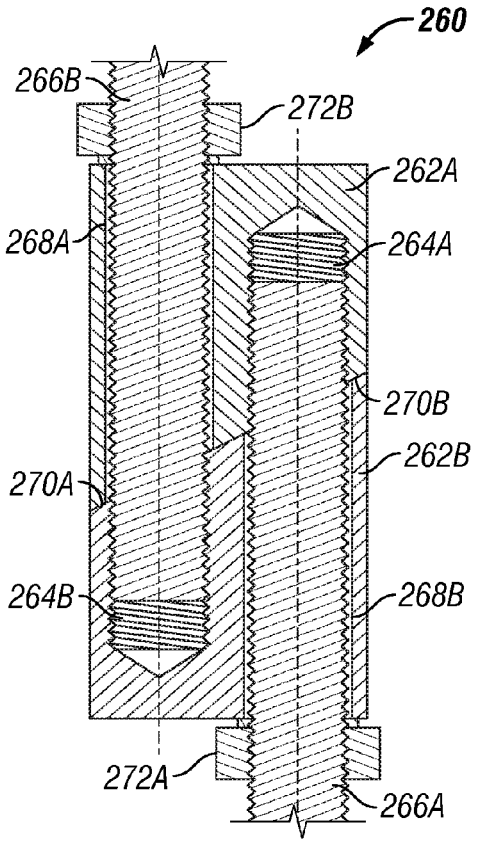
FIG. 12 is a top plan view of another offset tie rod adaptor according to an alternate embodiment.
Figure 13:
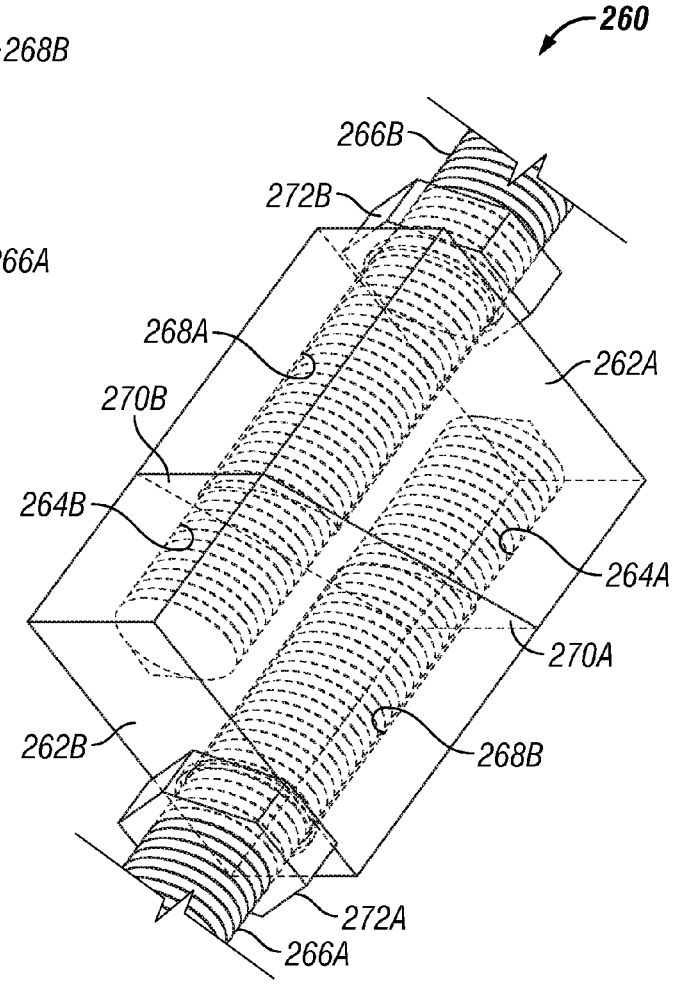
FIG. 13 is a perspective view of the adaptor of FIG. 12 according to an embodiment.

FIGS. 12-13 illustrate another embodiment of an offset tie rod adaptor or an offset bolt adaptor in the form of a block 260 comprised of two split sections 262A, 262B. The block 260 is generally rectangular on all sides. Each section 262A, 262B has threaded bores 264A, 264B to threadedly receive the tie rods 266A, 266B and enlarged through bores 268A, 268B to slideably receive the tie rods 266A, 266B. The threaded bore 264A is aligned with through bore 268B, and the threaded bore 264B with through bore 268A. To compensate for the bending moment due to the lateral offset of the tie rods 266A, 266B, opposing surfaces 270A, 270B at which the two sections 262A, 262B are in abutment, may be transversely oriented with respect to a plane that is at a right angle to the bores. The tie rods 266A, 266B can be secured by nuts 272A, 272B opposite the through bores 268A, 268B.

Figure 14:
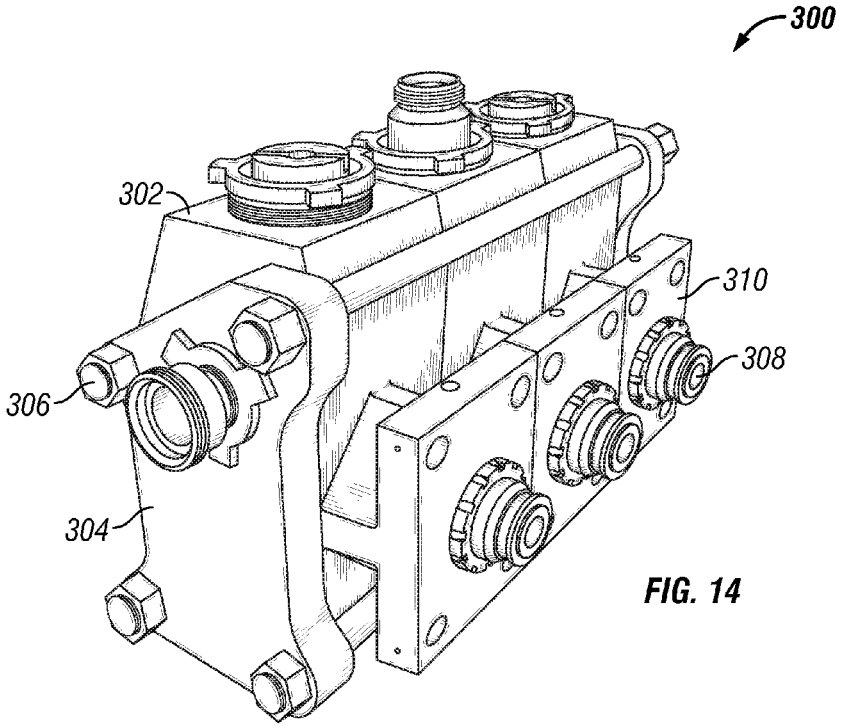
FIG. 14 is a perspective view of a fluid end assembly according to an embodiment.
Figure 15:
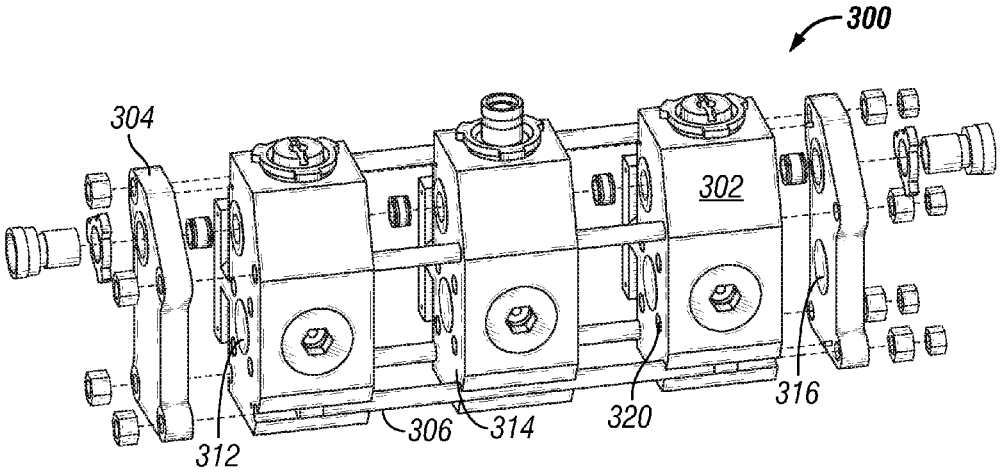
FIG. 15 is an exploded view of the fluid end assembly of FIG. 14.

FIG. 14-15 show a modular fluid end assembly 300 for a multiplex pump including a plurality of fluid end modules 302 secured between end plates 304 by means of fasteners 306. The end plates 304 are utilized in conjunction with the fasteners 306 to assemble the pump bodies 302 to form the fluid end assembly 300. When the fluid end 300 is assembled, the three pump modules 302 are assembled together using, for example, four large fasteners or tie rods 306 and the end plates 304 on opposing ends of the pump modules 302. At least one of the tie rods 306 may extend through the pump modules 302, while the other of the tie rods 306 may be external of the pump modules 302. In addition to the triplex configuration of fluid end assembly 300, those skilled in the art will appreciate that the pump modules 302 may also be arranged in other configurations, such as a quintuplex pump assembly comprising five pump modules 302, or the like Each pump module 302 has an internal passage or bore to receive a pump plunger 308 through the fluid end connection block 310, which provides a flange for guiding and attaching the pistons in the pump modules 302 to the drive rods of the power end and ultimately to a prime mover, such as a diesel engine or the like, as will be appreciated by those skilled in the art.

The pump modules 302 may further define inlet and outlet ports which may be substantially perpendicular to the piston bore in a crossbore arrangement, i.e., pump modules 302 may define substantially similar internal geometry as prior art monoblock fluid ends to provide similar volumetric performance. Those skilled in the art will appreciate that the internals of the pump modules 302 may comprise bores formed in other configurations such as a T-shape, Y-shape, in-line, or other configurations.

In one embodiment, a raised surface 312 extends from an exterior surface 314 of the pump modules 302, best seen in FIG. 15. The raised surface 312 may extend a predetermined distance from the exterior surface 314 and may define a predetermined area on the exterior surface 314. While illustrated as circular in shape, the raised surface 312 may be formed in any suitable shape. The end plates 304 may further comprise a raised surface 316, similar to the surface 312 on the pump modules 302 for engaging with the raised surfaces 312 during assembly.

The tie rods or fasteners 306 may be tightened utilizing a hydraulic tensioner, as will be appreciated by those skilled in the art. The tensioner may have its hydraulic power provided by the outlet flow of the pump assembly 300 itself. The hydraulic tensioner may provide a constant tension or a variable tension on the tie rods 306, depending on the requirements of the operation of the assembly 300. As the tie rods 306 are tightened, via threaded nuts 318 or the like, to assemble the fluid end 300, the raised surfaces 312, 316 engage with one another to provide a pre-compressive force to the areas adjacent the intersection of the internal bores. The pre-compressive force may counteract the potential deformation of the areas adjacent the intersection of the internal bores due to the operational pressure. By counteracting the potential deformation due to operational pressure, stress on the adjacent areas is reduced, thereby increasing the overall life of the pump bodies by reducing the likelihood of fatigue failures.

Due to the substantially identical profiles of the plurality of fluid end modules 302, the fluid end modules 302 may be advantageously interchanged between the middle and side pump bodies of the fluid end assembly, providing advantages in assembly, disassembly, and maintenance, as will be appreciated by those skilled in the art. In operation, if one of the fluid end modules 302 of the fluid end assembly 300 fails, only the failed one of the fluid end modules 302 need be replaced, reducing the potential overall downtime of the fluid end assembly 300 and its associated monetary impact. The fluid end modules 302 are smaller than a typical monoblock fluid end having a single body with a plurality of cylinder bores machined therein and therefore provide greater ease of manufacturability due to the reduced size of forging, castings, etc.

While illustrated as comprising three of the fluid end modules 302, the fluid end assembly 300 may be formed in different configurations, such as by separating or segmenting each of the fluid end modules 302 further, by segmenting each of the fluid end modules 302 in equal halves along an axis that is substantially perpendicular to the surfaces 314, or by any suitable segmentation.

The fluid end modules 302 may be further pre-compressed in another additional or alternative embodiment in order to counteract the potential deformation of internal areas, by expanding one or more displacement plugs 320 disposed at predetermined locations within the fluid end modules 302. The plugs 320 are placed in, for example, a drilled bore or cavity formed in the fluid end modules 302 and expanded with the use of an expansion tool and/or application of a radial force to the drilled bore or cavity, as will be appreciated by those skilled in the art. The bore formed in the fluid end modules 302 may be cylindrical for a cylindrical plug 320, or tapered to accommodate a tapered plug 320 therein.

The expansion of the displacement plug 320 by application of a radial force induces a radial plastic yielding of the plug 320 and an elastic radial deformation of the surrounding material of the fluid end modules 302. When the radial force is removed in one embodiment, the plug 320 contracts slightly radially inward due elastic relaxation; however, the radial deformation of the surrounding material of the fluid end modules 302 does not completely vanish following the relaxation because the elastic radial deformation of the fluid end modules 302 is larger than the plastic radial deformation of the plug 320. As a result, there is a remaining stress between the plug 320 and the fluid end module 302 after relaxation.

The pre-compressive force in an embodiment may also be hydraulically or pneumatically applied pressure, for example, via suitable sealed hydraulic or pneumatic connections to the cavity. The pre-compressive force in an embodiment may be applied by injecting a liquid or semi-liquid material into the bore that expands as it solidifies, the expansion of the material providing the pre-compressive force. In another embodiment where the plug 320 is permanently expanded or otherwise larger than the cavity in which it is received in the fluid end modules 302, the plug 320 displaces the area around the plug, maintaining stress against the abutting surface of the cavity.

Accordingly, the invention provides the following embodiments:

A. A pump assembly, comprising: a power end comprising a plurality of reciprocatable drive rods arranged in a first geometric pattern; a fluid end comprising a plurality of plungers arranged in a second geometric pattern wherein the second geometric pattern is different from the first geometric pattern; and an adaptor to connect the power end to the fluid end, wherein the adaptor comprises an offset coupler to attach a said drive rod to an offset one of the plungers.

B. The pump assembly of embodiment A wherein the adaptor further comprises an in-line coupler to attach a said drive rod to an aligned one of the plungers.

C. The pump assembly of embodiment A or embodiment B wherein the first and second geometric patterns comprise a straight line, wherein the drive rods and plungers are transversely oriented on opposite sides of the line, and wherein a spacing between the drive rods is different from a spacing between the plungers.

D. The pump assembly of any one of embodiments A to C, comprising a triplex or quintuplex fluid end wherein a middle one of the plungers is coupled in alignment with a corresponding middle one of the drive rods, and wherein side ones of the plungers are connected with corresponding side ones of the drive rods using a respective plurality of the offset couplers.

E. The pump assembly of any one of embodiments A to D wherein the offset coupler comprises an eccentric clamp.

F. The pump assembly of embodiment E wherein the eccentric clamp comprises a split housing halves, a first opening and recess to receive the drive rod and an enlarged end thereof, a second opening and recess to receive the plunger and an enlarged end thereof, and a plurality of bolts to removable secure the housing halves.

G. The pump assembly of any one of embodiments A to F wherein the adaptor further comprises a plurality of tie rods secured at opposite ends to the power end and the fluid end, wherein at least one of the tie rods includes an offset tie rod adapter to attach a first tie rod section from the power end with an offset second tie rod section from the fluid end.

H. The pump assembly of embodiment G wherein the offset tie rod adaptor comprises opposing first and second elongated blocks abutting at a sloping transverse surface, a through bore and a threaded bore formed in each of the first and second blocks, wherein the through bores of the first and second blocks are aligned at the transverse surface with the threaded bores of the respective second and first blocks, wherein the through bores are formed longitudinally in a portion of the blocks that is longer than a portion of the blocks in wherein the threaded bores are formed, wherein the first tie rod section is slideably received in the through bore of the first block and threadedly engaged in the threaded bore of the second block and wherein the second tie rod section is slideably received in the through bore of the second block and threadedly engaged in the threaded bore of the first block.

I. The pump assembly of any one of embodiments A to H wherein the fluid end comprises a plurality of pump body modules secured together to form the fluid end.

J. The pump assembly of embodiment I wherein the pump body modules are secured in a line with fasteners between opposite end plates.

K. A pump assembly and maintenance system, comprising: (a) a standby inventory of standard fluid end assemblies comprising a standard plunger and tie rod configuration; (b) a standby inventory of a plurality of different sets of power end units, wherein each set of power end units has a different drive rod and tie rod configuration with respect to the other power end sets, including at least one set of offset power ends having an offset drive rod and tie rod configuration with respect to the standard plunger and tie rod configuration; (c) a standby inventory of adapter units to connect the offset power ends to the standard fluid ends; and (d) a population of pump assemblies in service, comprising in-service pump assemblies comprising a said standard fluid end, a said adapter unit and a said offset power end, whereby the in-service pump assemblies can be repaired by removing the power end and replacing with a said power end from the standby inventory thereof wherein the replacement power end has a different drive rod and tie rod configuration with respect to the removed power end.

L. The pump assembly and maintenance system of embodiment K wherein the inventory of power end units further comprise a set of standard power ends having a drive rod and tie rod configuration matching the standard plunger and tie rod configuration, and wherein the population of in-service pump assemblies further comprises pump assemblies comprising a standard power end coupled directly to a standard fluid end.

M. The pump assembly and maintenance system of embodiment K or embodiment L wherein the inventory of standard fluid end assemblies further comprises interchangeable pump body modules, wherein the fluid end assemblies comprise a plurality of the modules, whereby the in-service pump assemblies can be repaired by removing and replacing the standard fluid end assembly or one or more of the interchangeable pump body modules.

N. A method, comprising: (a) providing a power end comprising a plurality of reciprocatable drive rods arranged in a first geometric pattern; (b) providing a fluid end comprising a plurality of plungers arranged in a second geometric pattern wherein the second geometric pattern is different from the first geometric pattern; and (c) connecting the power end to the fluid end via an adaptor comprising an offset coupler to attach a said drive rod to an offset one of the plungers.

O. The method of embodiment N, further comprising attaching a said drive rod to an aligned one of the plungers.

P. The method of embodiment N or embodiment O, further comprising transversely orienting the drive rods and plungers on opposite sides of a straight line wherein spacing between the drive rods is different from spacing between the plungers.

Q. The method of any one of embodiments N to P, wherein the fluid end comprises a triplex or quintuplex fluid end assembly, and further comprising coupling a middle one of the plungers in alignment with a corresponding middle one of the drive rods, and connecting side ones of the plungers with corresponding side ones of the drive rods at a respective plurality of the offset couplers.

R. The method of any one of embodiments N to Q further comprising securing the power end and the fluid end together by securing opposite ends of a plurality of tie rods to the power end and the fluid end, comprising attaching a first tie rod section from the power end to an offset second tie rod section from the fluid end at an offset tie rod adapter.

S. The method of any one of embodiments N to R comprising assembling the fluid end from a plurality of pump body modules secured together.

T. The method of embodiment S comprising securing the pump body modules in a line with fasteners between opposite end plates.

U. A method, comprising: (a) providing a standby inventory of standard fluid end assemblies comprising a standard plunger and tie rod configuration; (b) providing a standby inventory of a plurality of different sets of power end units, wherein each set of power end units has a different drive rod and tie rod configuration with respect to the other power end sets, including at least one set of offset power ends having an offset drive rod and tie rod configuration with respect to the standard plunger and tie rod configuration; (c) providing a standby inventory of adapter units adapted to connect the offset power ends to the standard fluid ends; (d) connecting a said standard fluid end, a said adapter unit and a said offset power end from the standby inventories into a pump assembly; (e) placing a plurality of the pump assemblies in service; and (f) removing the power end of one of the in-service pump assemblies for repair or maintenance and replacing it with a said power end from the standby inventory, wherein the replacement power end has a different drive rod and tie rod configuration with respect to the removed power end.

V. The method of embodiment U wherein the inventory of standard fluid end assemblies further comprises interchangeable pump body modules, wherein the fluid end assemblies comprise a plurality of the modules, and further comprising removing the standard fluid end assembly or one or more of the interchangeable pump body modules for repair or maintenance and replacing it with another one from the inventory of standard fluid end assembly or one or more of the interchangeable pump body modules.

W. The method of embodiment U or embodiment V wherein the inventory of power end units further comprise a set of standard power ends having a drive rod and tie rod configuration matching the standard plunger and tie rod configuration, and further comprising connecting a said standard fluid end and a said standard power end from the respective inventories into a pump assembly.

X. Any one of the pump assembly of embodiment I or embodiment J, or the pump assembly and maintenance system of embodiment M, further comprising raised surfaces on opposite exterior side surfaces of the pump body modules, wherein the raised surfaces engage with an adjacent end plate or the raised surface of an adjacent pump body module, whereby the tightening of the fasteners applies a pre-compressive force at the raised surfaces on each of the pump body modules.

Y. Any one of embodiment I, embodiment J, embodiment M, or embodiment X, further comprising an expanded displacement plug in a cavity formed in the pump body modules, wherein the expanded displacement plug applies a pre-compressive force at the cavity on each of the pump body modules.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A pump assembly, comprising:

a power end comprising a plurality of reciprocatable drive rods arranged in a first geometric pattern;

a fluid end comprising a plurality of plungers arranged in a second geometric pattern wherein the second geometric pattern is different from the first geometric pattern, wherein the fluid end comprises a triplex or quintuplex fluid end; and an adaptor to connect the drive rods of the power end to the plungers of the fluid end, wherein the adaptor comprises a plurality of offset couplers, wherein a middle one of the plungers is coupled in alignment with a corresponding middle one of the drive rods, and wherein offset side ones of the plungers are connected with corresponding side ones of the drive rods using the offset couplers.

2. The pump assembly of claim 1 wherein the adaptor further comprises an in-line coupler to attach one of the drive rods to an aligned one of the plungers.

3. The pump assembly of claim 1, wherein a spacing between the drive rods is different from a spacing between the plungers.

4. The pump assembly of claim 1 wherein the offset couplers comprise an eccentric clamp.

5. The pump assembly of claim 4 wherein the eccentric clamp comprises split housing halves, each half comprising a first opening and recess to receive one of the plurality of drive rods and an enlarged end thereof, a second opening and recess to receive one of the plurality of plungers and an enlarged end thereof, and at least one bolt to removably secure the housing halves to one another.

6. The pump assembly of claim 1 wherein the adaptor further comprises a plurality of tie rods secured at opposite ends to the power end and the fluid end, wherein at least one of the tie rods comprises an offset tie rod adapter attached at one end to a first tie rod section from the power end and attached at an opposite end to an offset second tie rod section from the fluid end.

7. The pump assembly of claim 6 wherein the offset tie rod adaptor comprises opposing first and second elongated blocks abutting at a sloping transverse surface, a through bore and a threaded bore formed in each of the first and second elongated blocks, wherein the through bores of the first and second elongated blocks are aligned at the sloping transverse surface with the threaded bores of the respective second and first elongated blocks, wherein the through bores are formed longitudinally in a portion of the elongated blocks that is longer than a portion of the elongated blocks where the threaded bores are formed, wherein the first tie rod section is slideably received in the through bore of the first elongated block and threadedly engaged in the threaded bore of the second elongated block and wherein the second tie rod section is slideably received in the through bore of the second elongated block and threadedly engaged in the threaded bore of the first elongated block.

8. The pump assembly of claim 1 wherein the fluid end comprises a plurality of pump body modules secured together to form the fluid end.

9. The pump assembly of claim 8 wherein the pump body modules are secured in a line with fasteners between opposite end plates.

10. The pump assembly of claim 6 wherein the fluid end comprises a plurality of pump body modules secured together to form the fluid end.

11. The pump assembly of claim 10 wherein the pump body modules are secured in a line with fasteners between opposite end plates.

12. The pump assembly of claim 1 wherein the plurality of reciprocatable drive rods is equal in number to the plurality of plungers.

13. A method, comprising:

providing a power end comprising a plurality of reciprocatable drive rods arranged in a first geometric pattern;

providing a fluid end comprising a plurality of plungers arranged in a second geometric pattern wherein the second geometric pattern is different from the first geometric pattern, wherein the fluid end comprises a triplex or quintuplex fluid end assembly;

connecting the power end to the fluid end via an adaptor comprising a plurality of offset couplers; and coupling a middle one of the plungers in alignment with a corresponding middle one of the drive rods, and connecting side ones of the plungers with corresponding side ones of the drive rods using the offset couplers.

14. The method of claim 13, further comprising orienting the drive rods and plungers such that spacing between the drive rods is different from spacing between the plungers.

15. The method of claim 13, further comprising securing the power end and the fluid end together by securing opposite ends of a plurality of tie rods to the power end and the fluid end, comprising attaching a first end of an offset tie rod adaptor to a first tie rod section from the power end and attaching an opposite end of the offset tie rod adaptor to an offset second tie rod section from the fluid end.

16. The method of claim 13, comprising assembling the fluid end from a plurality of pump body modules secured together.

17. The method of claim 16 comprising securing the pump body modules in a line with fasteners between opposite end plates.

18. The method of claim 14, comprising assembling the fluid end from a plurality of pump body modules secured together, and securing the pump body modules in a line with fasteners between opposite end plates.

19. The method of claim 15, comprising assembling the fluid end from a plurality of pump body modules secured together, and securing the pump body modules in a line with fasteners between opposite end plates.

20. The method of claim 13 wherein providing a fluid end comprises providing a plurality of plungers equal in number to the plurality of reciprocatable drive rods.

* * * * *